US006641003B1

(12) United States Patent
Foster et al.

(10) Patent No.: US 6,641,003 B1
(45) Date of Patent: Nov. 4, 2003

(54) LOW COST TRIGGER SPRAYER WITH DOUBLE VALVE ELEMENT

(75) Inventors: Donald D. Foster, St. Charles, MO (US); Philip L. Nelson, Wildwood, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 10/288,944

(22) Filed: Nov. 6, 2002

(51) Int. Cl.[7] ..... B67D 5/40
(52) U.S. Cl. ..... 222/383.1
(58) Field of Search ..... 222/380, 383.1

(56) References Cited

U.S. PATENT DOCUMENTS

| | | | | | |
|---|---|---|---|---|---|
| 4,527,741 | A | * | 7/1985 | Garneau | 222/383.1 |
| 5,341,965 | A | * | 8/1994 | Maas et al. | 222/383.1 |
| 5,509,608 | A | | 4/1996 | Foster et al. | |
| 6,116,472 | A | * | 9/2000 | Wanbaugh et al. | 222/383.1 |

* cited by examiner

*Primary Examiner*—Philippe Derakshani
(74) *Attorney, Agent, or Firm*—Thompson Coburn LLP

(57) ABSTRACT

A trigger sprayer construction is provided with a single valve member having both a sleeve valve and a disk valve on the single valve member that is assembled into a sprayer housing having a continuous discharge passage and supply passage to provide a trigger sprayer construction with a reduced number of separate component parts.

27 Claims, 5 Drawing Sheets

LOW COST TRIGGER SPRAYER WITH DOUBLE VALVE ELEMENT

BACKGROUND OF THE INVENTION (1) Field of the Invention

The present invention pertains to a low cost construction of a hand held and hand operated liquid sprayer typically called a trigger sprayer. In particular, the present invention pertains to a double valve element that is employed in the trigger sprayer construction in lieu of two separate valve elements typically employed in prior art trigger sprayer constructions. The double valve element reduces the number of component parts of the trigger sprayer and thereby reduces its cost of manufacturing.

(2) Description of the Related Art

Hand held and hand operated liquid sprayers commonly known as trigger sprayers are well known in the liquid sprayer art. Trigger sprayers are commonly used to dispense household cleaning or cooking liquids in a stream, spray pattern or as a foam. A trigger sprayer is typically connected to a plastic bottle containing the liquid dispensed by the trigger sprayer.

A typical trigger sprayer is comprised of a sprayer housing that is connected to a neck of the liquid containing bottle by either a threaded connection or a bayonet-type connection. The sprayer housing is formed with a pump chamber, a vent chamber, a liquid discharge passage communicating the pump chamber with an outlet orifice of the trigger sprayer and a liquid supply passage communicating the pump with a dip tube that extends into the liquid of the bottle when the trigger sprayer housing is attached to the bottleneck.

A pump piston is mounted in the pump chamber for reciprocating movements of the pump piston between charge and discharge positions relative to the pump chamber. A vent piston is often connected to the pump piston and is mounted in the vent chamber for reciprocating movements of the vent piston between a closed venting position and an open venting position of the vent piston relative to the vent chamber. In the open venting position of the vent piston the interior of the bottle is vented to the exterior environment of the trigger sprayer. In the closed position of the vent piston the vent chamber is sealed and thereby the interior of the bottle is sealed from the exterior environment of the trigger sprayer. A spring is usually provided in the sprayer housing pump chamber for biasing the pump piston and the vent piston toward their respective charge and closed positions.

A trigger is mounted on the sprayer housing by a pivot connection at one end of the trigger. The trigger is also connected to the pump piston and the vent piston. Repeating the sequence of manually squeezing the trigger toward the sprayer housing against the bias of the pump chamber spring, and then releasing the trigger oscillates the trigger about its pivot connection and reciprocates the pump piston between its charge and discharge positions relative to the pump chamber as well as reciprocates the vent piston between its closed and open positions relative to the vent chamber.

A pair of check valves or one-way valves are assembled in the sprayer housing. One of the check valves, often comprised of a ball valve and a ball valve seat, is provided in the sprayer housing between the pump chamber and the liquid supply passage. This ball valve controls the flow of liquid from the dip tube and through the supply passage to the pump chamber and prevents the reverse flow of liquid from the pump chamber to the dip tube. The second check valve, also often comprised of a ball valve and a ball valve seat, is positioned between the pump chamber and the liquid discharge passage and controls the flow of liquid from the pump chamber to the liquid discharge passage and prevents the reverse flow of liquid from the liquid discharge passage to the pump chamber.

A nozzle assembly having a discharge orifice is assembled to the sprayer housing at the outlet of the liquid discharge passage. The liquid discharge passage usually contains a liquid spinner assembly. The spinner assembly has a liquid spinner head at one end adjacent the nozzle orifice.

From the manual oscillating movement of the trigger that reciprocates the pump piston in the pump chamber, the liquid is drawn from the bottle through the dip tube past the first check valve to the pump chamber. The liquid is then pumped from the pump chamber through the liquid discharge passage and the second check valve to the liquid spinner and the discharge orifice and is dispensed from the trigger sprayer.

The typical trigger sprayer described above has several separate component parts that all contribute to the overall cost of manufacturing the trigger sprayer. Because the typical trigger sprayer is manufactured and sold in very large volumes, even the slightest reduction in the manufacturing cost of the trigger sprayer can result in significant overall reductions in the cost of manufacturing of trigger sprayers. Thus, it is desirable to reduce the number of separate component parts of the trigger sprayer to reduce its manufacturing costs

SUMMARY OF THE INVENTION

The low cost trigger sprayer of the present invention reduces manufacturing costs by reducing the number of separate component parts that are assembled into the trigger sprayer. More specifically, the low cost trigger sprayer of the invention is constructed with a double valve member, replacing the two separate check valves of the prior art trigger sprayer with a single member that performs the functions of the two prior art check files.

The trigger sprayer has a sprayer housing that is similar to the sprayer housings of prior art trigger sprayers in that it comprises a pump chamber, a vent chamber, a liquid discharge passage and a liquid supply passage. The sprayer housing also has an integral connector cap that attaches the trigger sprayer to a separate bottle containing a liquid to be dispensed by the trigger sprayer. However, the sprayer housing differs from prior art sprayer housings in that a portion of the liquid discharge passage and a portion of the liquid supply passage are formed as a single continuous passage that extends vertically upwardly through the sprayer housing from the bottom of the housing. The top of the continuous vertical passage communicates with the remainder of the liquid discharge passage that extends to the liquid spinner in the sprayer housing.

A nozzle cap is attached to the sprayer housing adjacent the liquid spinner. The nozzle cap has a discharge orifice position adjacent the liquid spinner that discharges the liquid pumped from the bottle by the trigger sprayer.

The pump chamber communicates with the continuous passage through both an inlet passage and an outlet passage. The inlet passage and the outlet passage are spaced from each other along the continuous passage of the sprayer housing. The vent chamber also communicates with the continuous passage of the sprayer housing through a vent passage that communicates the vent chamber with the continuous passage.

The single valve member is inserted into the continuous passage of the sprayer housing and is positioned in the continuous passage between the pump chamber inlet passage and the pump chamber outlet passage. The single valve member has a cylindrical base that seats in the continuous passage of the sprayer housing between the pump chamber inlet passage and the pump chamber outlet passage and divides the continuous passage of the sprayer housing into the liquid discharge passage on one side of the valve member base and the liquid supply passage on the other side of the valve member base. A resilient sleeve or tube valve projects upwardly from the valve member base and engages against the interior surface of the liquid discharge passage covering over the pump chamber outlet passage. Thus, the resilient tube valve functions as the check valve in the liquid discharge passage that allows liquid flow from the pump chamber to the liquid discharge passage but prevents the reverse flow of liquid.

A stem projects downwardly from the center of the valve base and a resilient disk valve is provided on the distal end of the stem. The length of the stem positions the disk valve below the pump chamber inlet passage in the liquid supply passage.

A cylindrical valve seat insert is inserted into the liquid supply passage below the disk valve. The valve seat insert has an annular peripheral surface that seats against a portion of the disk valve adjacent its peripheral surface. An interior bore extends through the valve seat insert and defines a portion of the liquid supply passage. The dip tube is inserted into the valve seat interior bore at the bottom of the valve seat. Thus, the disk valve seating against the annular peripheral surface of the valve seat insert functions as the check valve that allows liquid flow through the dip tube and the liquid supply passage to the pump chamber, but prevents the reverse flow of liquid.

A manual trigger is attached to the exterior of the sprayer housing and is operatively connected to the pump piston and vent piston to cause the pistons to reciprocate through their respective pump chamber and vent chamber on manual manipulation of the trigger. The trigger has a pair of integral spring arms that bias the trigger away from the sprayer housing. The spring arms eliminate the need for a separate coil spring in the sprayer housing. The reciprocation of the pump piston between charge and discharge positions of the pump piston in the pump chamber draws liquid through the dip tube and unseats the disk valve allowing the liquid to be drawn through the liquid supply passage and the pump chamber inlet passage into the pump chamber. Reciprocation of the pump piston also forces the liquid from the pump chamber through the pump chamber outlet passage displacing the resilient tube valve from its engagement with the interior surface of the liquid discharge passage and pumping the liquid through the liquid discharge passage past the liquid spinner and out through the discharge orifice of the sprayer.

The construction of the trigger sprayer described above with the single valve element having both a disk valve to control the liquid drawn into the pump chamber and a tube valve to control the discharge of the liquid from the pump chamber reduces the component parts of prior art trigger sprayers by providing a single valve member with two valve elements. The integral spring arms of the trigger also eliminates the separate spring of the prior art trigger sprayer. The reduction in the number of component parts that go into the assembly of the trigger sprayer reduces its manufacturing costs.

DESCRIPTION OF THE DRAWINGS

Further features of the invention are set forth in the following detailed description of the preferred embodiment of the invention and in the drawing figures wherein.

DETAILED DESCRIPTION OF THE PREFERRED EMBODIMENT

Figure 3:
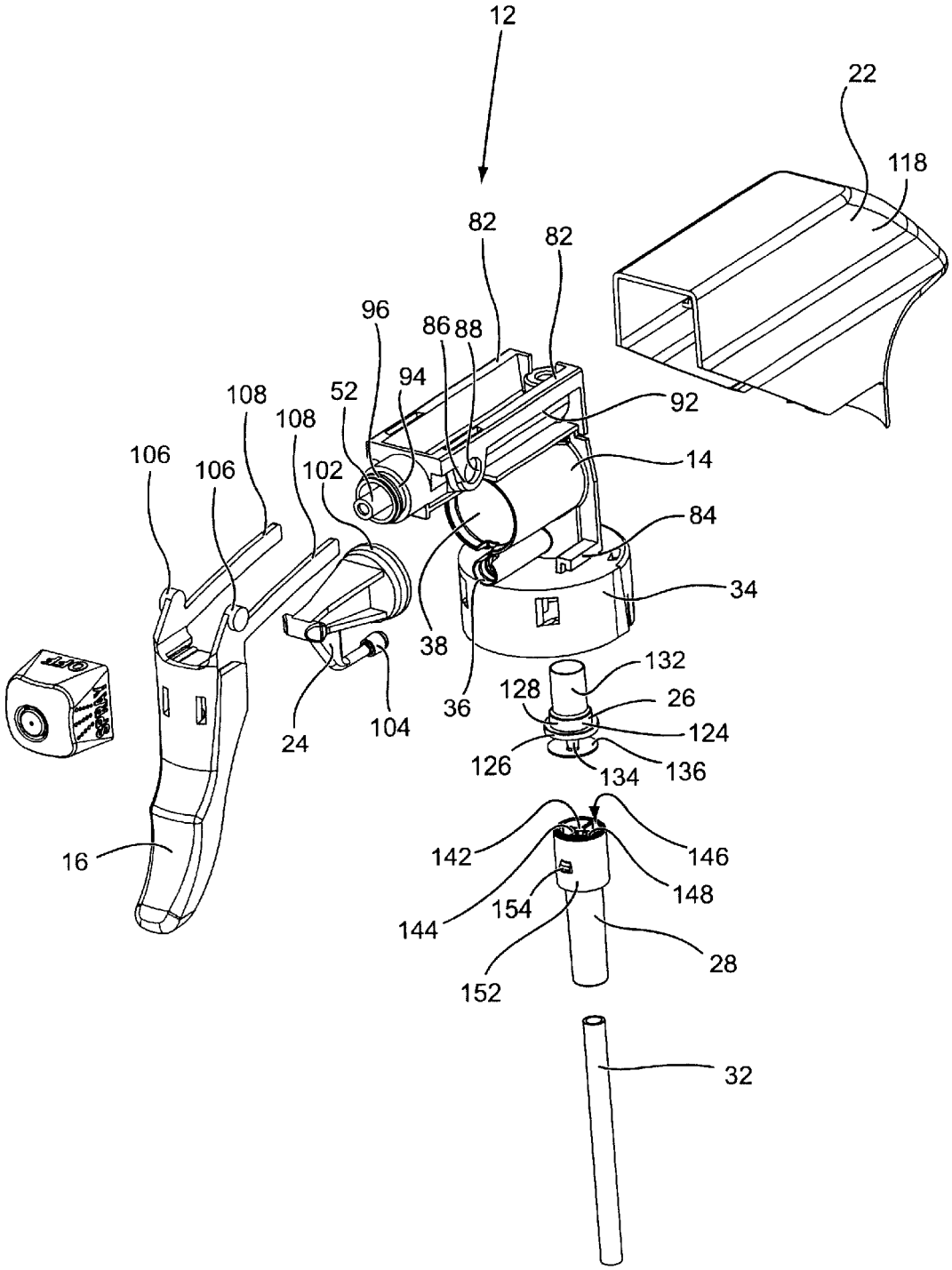
FIG. 3 is a perspective view of the disassembled component parts of the trigger sprayer.

FIG. 3 shows the disassembled eight component parts of the trigger sprayer 12 that include the sprayer housing 14, the trigger 16, the discharge nozzle 18, the sprayer shroud 22, the pump piston and vent piston assembly 24, the valve member 26, the valve seat insert 28 and the dip tube 32. Each of the eight component parts is constructed of a resilient plastic material, as is typical. However, the material employed in constructing the valve member 26 is more resilient and flexible than that of the other component parts of the trigger sprayer.

Figure 1:
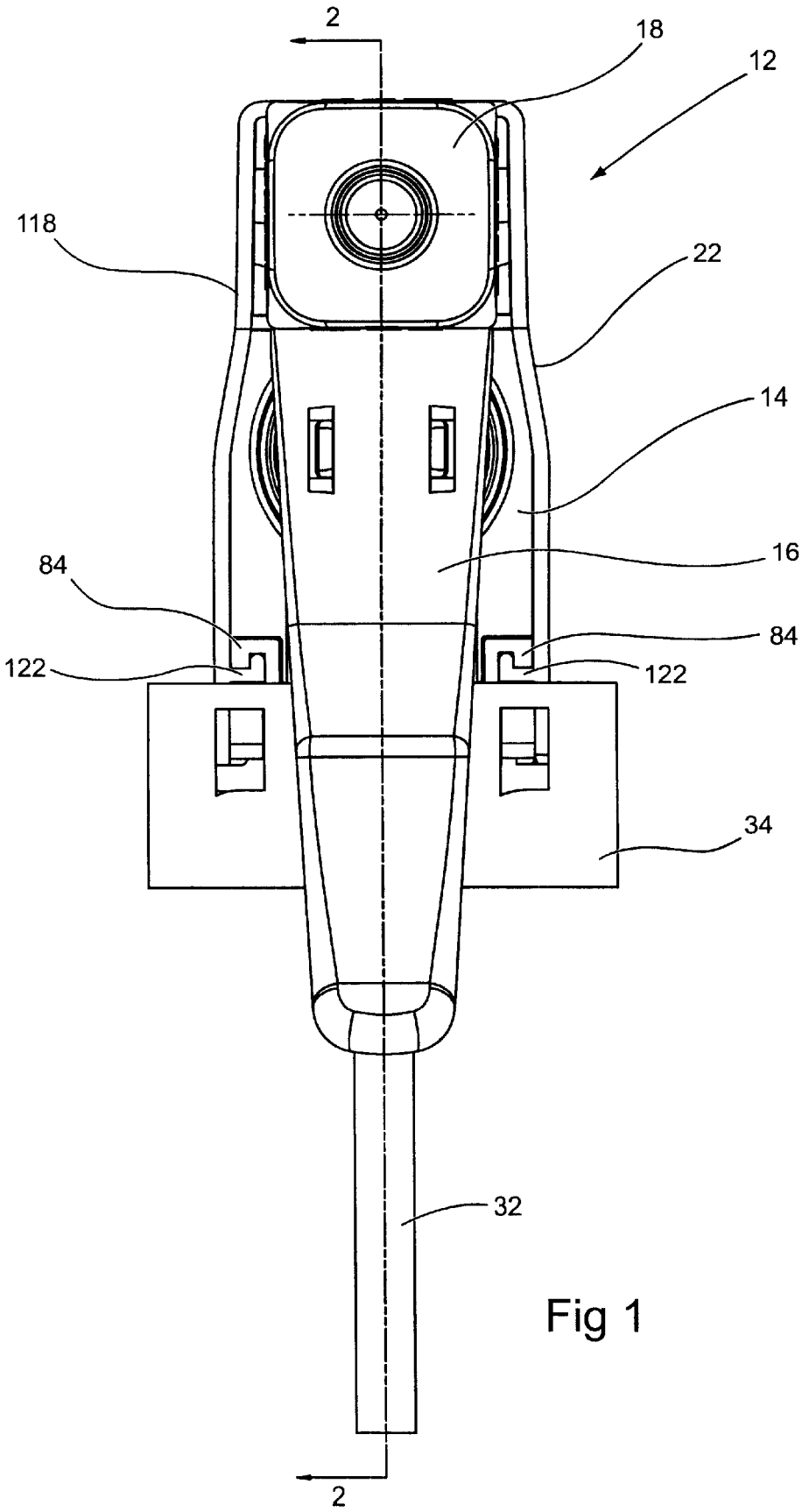
FIG. 1 is a front elevation view of the trigger sprayer of the invention.
Figure 2:
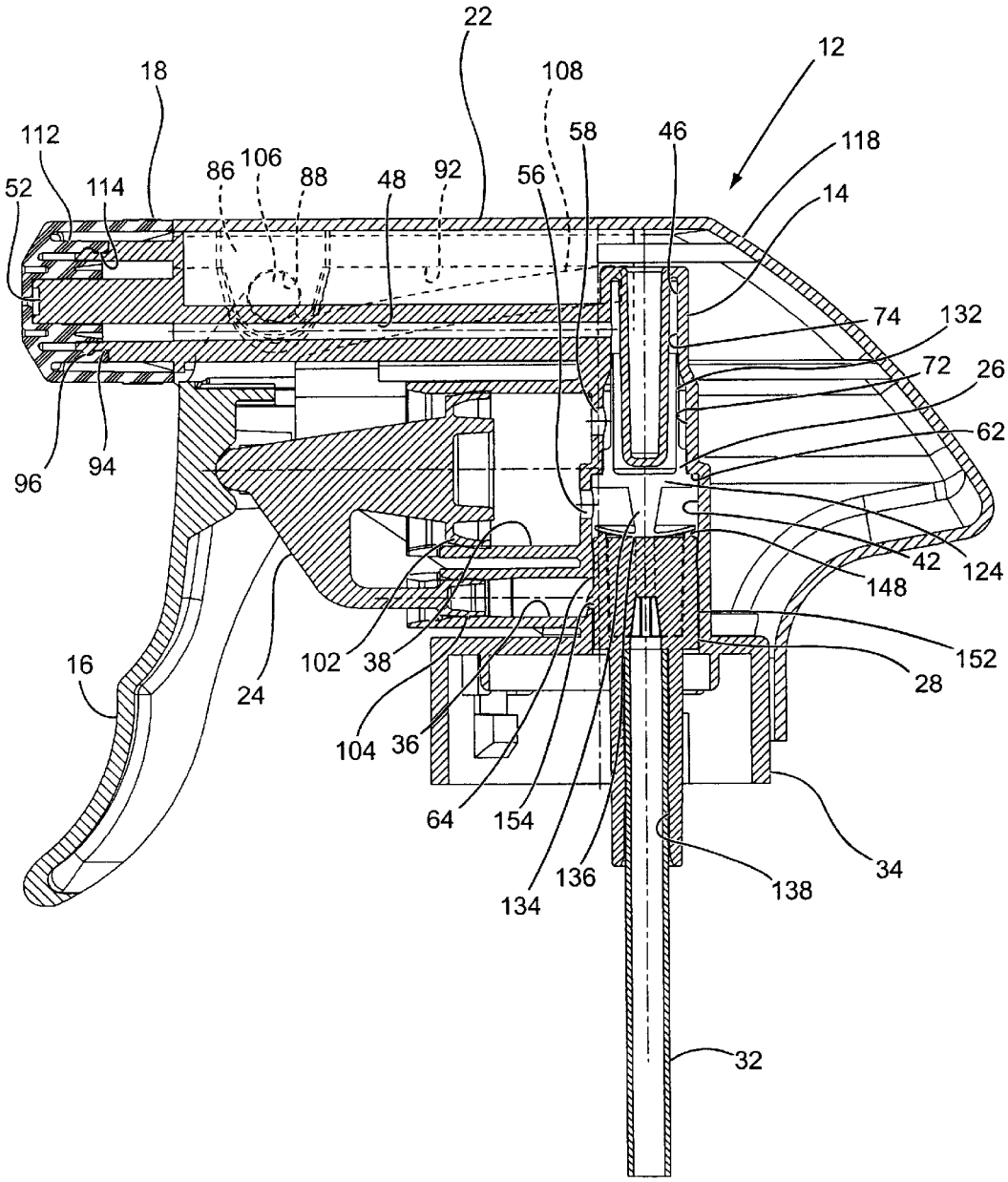
FIG. 2 is a side sectioned view of the trigger sprayer of the invention along the line 2—2 of FIG. 1.

Referring to FIGS. 1, 2 and 3, the sprayer housing 14 is constructed with a connector cap 34 that is an integral part of the sprayer housing. The connector cap 34 has a bayonet-type connector on its interior. However, other types of fasteners could be used, for example screw threading. In addition, the connector cap 34 could be a separate component part that is mounted on the sprayer housing 14 for rotation of the cap relative to the sprayer housing. However, in the preferred embodiment the connector cap 34 is an integral part of the sprayer housing 14 to reduce the number of separate component parts of the trigger sprayer.

The interior of the sprayer housing 14 is formed with a cylindrical vent chamber 36, a cylindrical pump chamber 38, a liquid supply passage with a cylindrical interior surface 42 and a liquid discharge passage that is comprised of a first, vertical section with a cylindrical interior surface 47 and a second horizontal section 48. The liquid supply passage 42 extends from an inlet opening in the sprayer housing to the pump chamber 38 and the liquid discharge passage 46, 48 extends from the pump chamber 38 to an outlet opening in the sprayer housing. A liquid spinner assembly 52 is provided at the outlet opening of the discharge passage second section 48. The construction of the spinner assembly 52, the discharge passage second section 48, the pump chamber 38 and vent chamber 36 are similar to those of prior art trigger sprayers. However, the supply passage 42 and the discharge passage first section 46 have a novel construction where together they comprise a single, common continuous passage that extends through the interior of the sprayer housing 14 from the connector cap 34 at the bottom of the sprayer housing to the discharge passage second section 48 at the top of the sprayer housing.

The continuous passage formed by the liquid supply passage 42 and the first section of the liquid discharge passage 46 communicates with the interior of the pump chamber 38 through a pump chamber inlet passage 56 and a pump chamber outlet passage 58. An annular shoulder surface 62 is formed in the continuous passage separating the supply passage interior surface 42 from the interior surface of the discharge passage first section 46. The annular surface 62 is positioned between the pump chamber inlet passage 56 and the pump chamber outlet passage 58. The continuous passage also communicates with the interior of the vent chamber 36 through a vent passage 64. The discharge passage first section 46 has a larger interior diameter portion 72 adjacent the pump chamber outlet passage 58 and a smaller interior diameter portion 74 adjacent the discharge passage second section 48.

The exterior surface of the sprayer housing 14 is provided with a flat top surface 82 for receiving the shroud 22. A pair of hooked channels 84 are also provided on the exterior of the sprayer housing 14 for mounting the shroud 22 on the housing. A pair of flanges 86 project downwardly from the opposite side of the sprayer housing adjacent its top surface 82. Each of the flanges 86 has a hole 88 for mounting the trigger 16 to the sprayer housing. A pair of ledges extend along the opposite sides of the exterior surface of the sprayer housing 14 just below the housing top surface 82. The housing has a cylindrical collar 94 that surrounds the outlet of the discharge passage second section 48. The collar 94 has a radially outwardly projecting rim 96 that receives the discharge nozzle 18.

The piston assembly 24 is comprised of a pump piston 102 and a vent piston 104 that are formed together as one integral piece. The pump piston 102 is mounted in the pump chamber 38 for reciprocating movements between charge and discharge positions of the pump piston relative to the pump chamber. The vent piston 104 is mounted in the vent chamber 36 for reciprocating movements between closed and opened positions of the vent piston 104 relative to the vent chamber 36. The functioning of the pump piston 102 to pump liquid through the sprayer housing 14 is known in the art and will not be explained in detail. Additionally, the functioning of the vent piston 104 to vent the interior of a container attached to the sprayer housing 14 is known in the art and will not be explained in detail. The piston assembly 24 is connected to the trigger 16 for reciprocating movement of the piston assembly in response to pivoting movement of the trigger. The piston assembly 24 is clipped to the trigger 16 so that the piston assembly is pushed into the pump and vent chambers 38, 36 and pulled out of the pump and vent chambers in response to the pivoting movement of the trigger 16 relative to the sprayer housing 14.

The trigger 16 has a pair of pivot pins 106 at the top of the trigger. The pins 106 are assembled to the sprayer housing 14 by pinching the pins toward each other and inserting the pins behind the sprayer housing flanges 86 until the pins line up with the flange holes 88. The resilience of the material of the trigger 16 causes the pins 106 to be biased outwardly into the flange holes 88 mounting the trigger 16 for pivoting movement on the housing 14. In addition, the trigger has a pair of spring arms 108 that project outwardly from the pivot pins 106. The spring arms 108 engage beneath the housing ledges 92 on the opposite sides of the sprayer housing 14 when the trigger 16 is mounted to the sprayer housing. The resiliency of the material employed in constructing the trigger 16 enables the spring arms 108 to function as springs. The spring arms 108 are bent as the trigger is moved manually toward the sprayer housing 14 to move the pump piston to its discharge position in the pump chamber, and the resilience of the spring arms 108 causes the trigger 16 to pivot away from the sprayer housing 14 and move the pump piston to its charge position in the pump chamber.

The discharge nozzle 18 has a cylindrical sleeve 112 with an annular rim 114 on the interior surface of the sleeve. The discharge nozzle 18 is press fit on the cylindrical collar 94 of the sprayer housing by pressing the cylindrical sleeve 112 over the collar 94 until the annular rim 114 on the sleeve interior surface passes over the annular rim 96 on the collar exterior surface. This snap fit connection of the discharge nozzle 18 to the sprayer housing 14 enables the discharge nozzle to rotate relative to the sprayer housing. The discharge nozzle 18 is provided with interior axial grooves that align with and come out of alignment with axial grooves provided on the spinner assembly 52, as is known in the art. This enables the discharge nozzle 18 to be selectively moved between an "off" position, a "spray" position and a "stream" position as is known in the prior art.

The shroud 22 is provided with an exterior surface 118 that is designed to give the trigger sprayer 12 an aesthetically pleasing appearance when the shroud is attached to the sprayer housing 14. The interior surface of the shroud is provided with a pair of j-shaped channels 122 that engage with the hooked channels 84 of the sprayer housing as the shroud is pressed forwardly onto the sprayer housing from the rear of the sprayer housing. The engagement of the shroud interior surface on the sprayer housing top surface 82 and the engagement of the shroud j-channels 122 in the sprayer housing hooked channels 84 securely holds the shroud 22 to the exterior of the sprayer housing 14.

Figure 4:
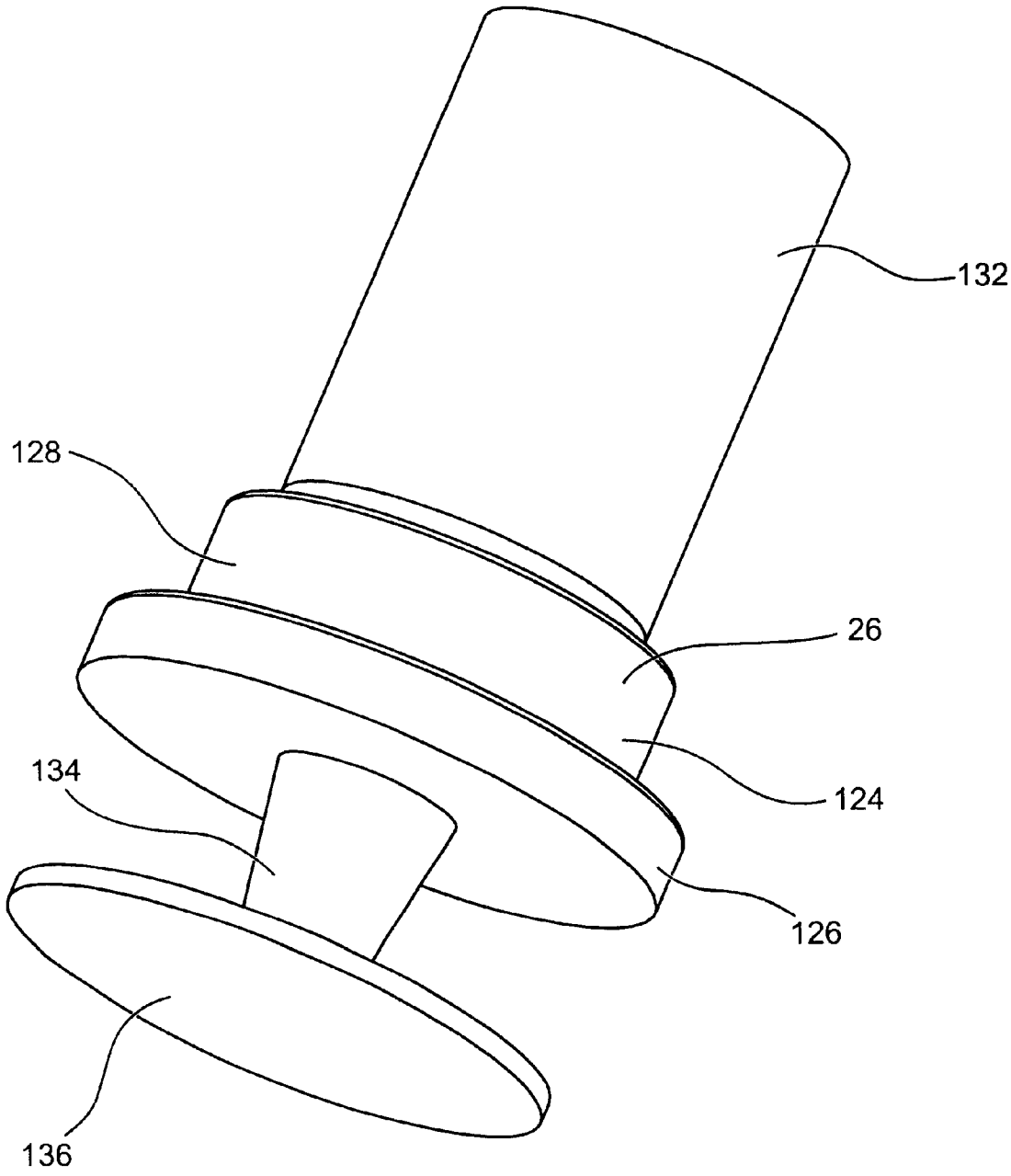
FIG. 4 is an enlarged perspective view of the valve member of the trigger sprayer.

As stated earlier, the valve member 26 is constructed of a resilient plastic material that is slightly more flexible than the remaining component parts of the trigger sprayer 12. Referring to FIG. 4, the valve member is constructed with a cylindrical base 124 that has a large exterior diameter portion 126 and a small exterior diameter portion 128. An outlet valve element in the form of a resilient hollow tube or sleeve valve 132 projects outwardly from the small exterior diameter portion 128 of the valve member base 124. The tube valve 132 has an exterior surface diameter dimension that is smaller than the interior diameter dimension of the large interior diameter portion 72 of the discharge passage and is slightly larger than the interior diameter dimension of the small interior diameter portion 74 of the discharge passage. A valve stem 134 projects outwardly from the large exterior diameter portion 126 of the valve member. An inlet valve element in the form of a disk valve 136 is provided on the distal end of the stem 134.

The valve member 26 is assembled into the continuous passage of the sprayer housing 14 defined by the first section of the discharge passage 46 and the liquid supply passage 42. The valve member is positioned in the sprayer housing as shown in FIG. 2 with the large exterior diameter portion 126 of the valve member base engaging against the annular interior surface 62 of the continuous passage. This positions the valve member base 124 between the pump chamber inlet passage 56 and the pump chamber outlet passage 58. In this position the valve member base 124 separates and seals the liquid supply passage 42 from the liquid discharge passage first section 46. In addition, the sleeve valve 132 is positioned in the liquid passage first section 46 adjacent the pump chamber outlet passage 58 and engaging in sealing engagement with the small interior diameter portion 74 of the discharge passage first section. The stem 134 of the valve member positions the disk valve 136 in the supply passage 42 below the pump chamber inlet passage 56.

Figure 5:
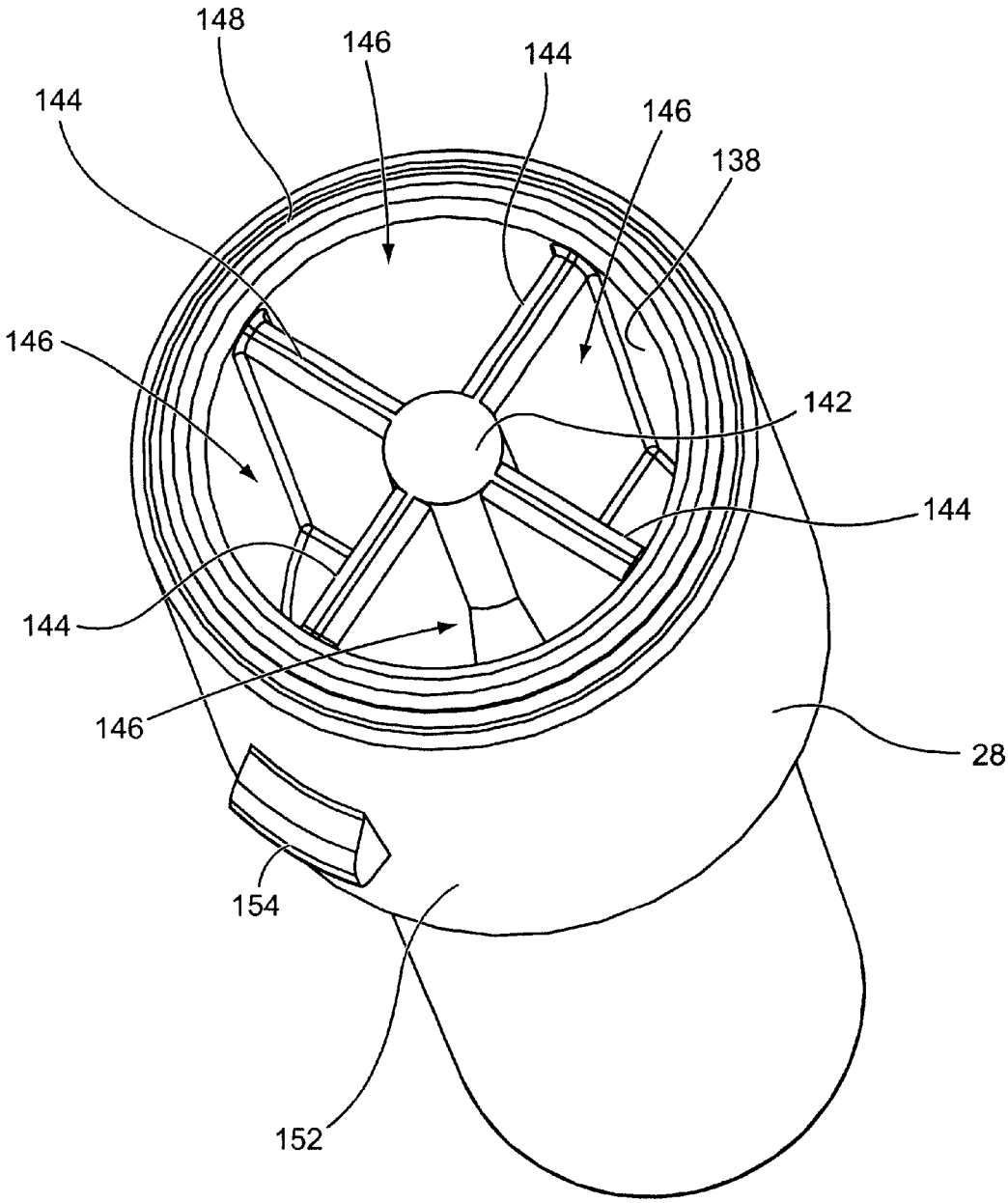
FIG. 5 is an enlarged perspective view of the valve seat insert of the trigger sprayer.

The valve seat insert 28 shown in FIG. 5 has a cylindrical interior bore 138 that extends entirely through the insert. The dip tube 32 is inserted into the bore 138 at the bottom of the insert and the dip tube 32 and the insert interior bore 138 form a portion of the liquid supply passage leading to the pump chamber inlet passage 56. A center column 142 is positioned in the center of the valve seat insert interior bore 138 by four flanges 144 spatially arranged around the center column 142. Open channels 146 are provided between the flanges 144. A circular valve seating surface 148 extends around the open channels 146. The circular valve seating surface 148 rises slightly above the end of the center column 142 and the four flanges 144 as can best be seen in FIG. 2. A cylindrical exterior surface 152 of the valve seat insert 28 is provided with an outwardly projecting tab 154.

As shown in FIG. 2, the valve seat insert 28 is assembled into the sprayer housing 14 by being inserted upwardly through the liquid supply passage 42 from the bottom of the sprayer housing. The insert 28 is inserted after the valve member 26 has been assembled into the sprayer housing 14. The insert 28 is pushed upwardly through the liquid supply passage 42 until the projecting tab 154 on the insert exterior surface engages in the vent chamber opening in the vent passage 64. This secures the valve seat insert 28 in the liquid supply passage 42. In this position of the valve seat insert 28 the center column 42 of the insert engages against the center of the disk valve 136 and the circular seating surface 148 of the insert engages against a peripheral portion of the disk valve 136 and pushes the disk valve peripheral portion slightly upwardly as shown in FIG. 2. This provides a sealing engagement between the insert circular seating surface 148 and the peripheral portion of the disk valve 136.

In the operation of the trigger sprayer 12 when the pump chamber 38 has not yet been primed with liquid and air fills the chamber, manually squeezing the trigger 16 toward the sprayer housing 14 compresses the air in the pump chamber 38. The compressed air is communicated through the pump chamber outlet passage 58 to the exterior surface of the sleeve valve 132. This causes the sleeve valve 132 to move away from its sealing engagement with the small interior diameter portion 74 of the discharge passage first section opening the discharge passage. The air from the pump chamber is pumped through the discharge passage and is dispensed from the trigger sprayer through the discharge nozzle 18. The pressure created in the pump chamber 38 causes the peripheral portion of the disk valve 136 to seat against the circular seating surface 148 of the valve seat insert 28 preventing the compressed air from being pumped downward through the dip tube 32 and into the liquid container attached to the trigger sprayer.

On manually releasing the trigger 16 the trigger spring arms 108 push the trigger away from the sprayer housing 14. This movement of the trigger pulls the pump piston 102 outwardly through the pump chamber 38 toward its charge position relative to the pump chamber. The removal of the fluid pressure on the exterior surface of the sleeve valve 132 causes the resilient sleeve valve to move into sealing engagement with the small interior diameter portion 74 of the discharge passage first section. This creates a vacuum in the pump chamber 38 that pulls the peripheral portion of the disk valve 136 out of engagement with the circular seating surface 148 of the valve seat insert 28 and draws liquid from the container up through the dip tube 32 and the liquid supply passage 42 into the interior of the pump chamber 38. By subsequent manual squeezing of the trigger 16 toward the sprayer housing 14 the liquid in the pump chamber 38 is forced through the pump chamber outlet passage 58 displacing the sleeve valve 32 from its sealing engagement with the small interior diameter portion 74 of the discharge passage first section and forcing the liquid through the discharge passage to be dispensed from the discharge nozzle 18.

The construction of the valve member 26 with a sleeve valve 132 and disk valve 136 on a single component part of the trigger sprayer 12, and the construction of the liquid discharge passage 46 and liquid supply passage 42 as a single continuous passage in the sprayer housing 14 into which the valve member 26 is inserted enables the trigger sprayer 12 to be constructed of only eight separate component parts. The reduction in the total number of component parts needed to assemble the trigger sprayer reduces its manufacturing costs.

Although only one embodiment of the trigger sprayer of the invention has been described above, it should be understood that other modifications and variations could be made to the trigger sprayer without departing from the scope of the invention defined by the following claims.

What is claimed is:

1. A manually operated trigger sprayer comprising:

a sprayer housing having a liquid outlet opening and a liquid inlet opening in the sprayer housing, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

a unitary valve member in the sprayer housing having an inlet valve element and an outlet valve element, the inlet valve element being positioned in the liquid supply passage and being movable between a closed position closing the liquid supply passage and an opened position opening the liquid supply passage in response to the pump piston moving to the discharge and charge positions, respectively, and the outlet valve element being positioned in the liquid discharge passage and being movable between a closed position closing the liquid discharge passage and an opened position opening the liquid discharge passage in response to the pump piston moving to the charge and discharge positions, respectively;

the pump chamber having an inlet passage that communicates the pump chamber with the liquid supply passage and the pump chamber having an outlet passage that communicates the pump chamber with the liquid discharge passage; and the valve member is positioned in the sprayer housing between the pump chamber inlet and outlet passages.

2. A manually operated trigger sprayer comprising:

a sprayer housing having a liquid outlet opening and a liquid inlet opening in the sprayer housing, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

a unitary valve member in the sprayer housing having an inlet valve element and an outlet valve element, the inlet valve element being positioned in the liquid supply passage and being movable between a closed position closing the liquid supply passage and an opened position opening the liquid supply passage in response to the pump piston moving to the discharge and charge positions, respectively, and the outlet valve element being positioned in the liquid discharge passage and being movable between a closed position closing the liquid discharge passage and an opened position opening the liquid discharge passage in response to the pump piston moving to the charge and discharge positions, respectively; and, one of the inlet valve element and the outlet valve element being a tube and one of the inlet valve element and outlet valve element being a disk.

3. The trigger sprayer of claim 2, further comprising:

the sprayer housing having a common passage in the sprayer housing between the liquid discharge passage and the liquid supply passage intercommunicating the liquid discharge passage and the liquid supply passage; and, the valve member being positioned in the common passage.

4. A manually operated trigger sprayer comprising:

a sprayer housing having a liquid outlet opening and a liquid inlet opening in the sprayer housing, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

a unitary valve member in the sprayer housing having an inlet valve element and an outlet valve element, the inlet valve element being positioned in the liquid supply passage and being movable between a closed position closing the liquid supply passage and an opened position opening the liquid supply passage in response to the pump piston moving to the discharge and charge positions, respectively, and the outlet valve element being positioned in the liquid discharge passage and being movable between a closed position closing the liquid discharge passage and an opened position opening the liquid discharge passage in response to the pump piston moving to the charge and discharge positions, respectively; and, the outlet valve element being a tube.

5. The trigger sprayer of claim 4, further comprising:

the liquid discharge passage having an interior surface;

the pump chamber having an outlet passage that opens through the liquid discharge passage interior surface and communicates the pump chamber with the liquid discharge passage; and the outlet valve element tube overlays the outlet passage and at least a portion of the liquid discharge passage interior surface in the closed position of the outlet valve element tube and the outlet valve element tube is displaced from the outlet passage and at least a portion of the liquid discharge passage interior surface in the opened position of the outlet valve element tube.

6. A manually operated trigger sprayer comprising:

a sprayer housing having a liquid outlet opening and a liquid inlet opening in the sprayer housing, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

a unitary valve member in the sprayer housing having an inlet valve element and an outlet valve element, the inlet valve element being positioned in the liquid supply passage and being movable between a closed position closing the liquid supply passage and an opened position opening the liquid supply passage in response to the pump piston moving to the discharge and charge positions, respectively, and the outlet valve element being positioned in the liquid discharge passage and being movable between a closed position closing the liquid discharge passage and an opened position opening the liquid discharge passage in response to the pump piston moving to the charge and discharge positions, respectively;

the inlet valve element being a disk;

a circular surface inside the sprayer housing and around the liquid supply passage; and the inlet valve element disk overlays the circular surface in the closed position of the inlet valve element disk and the inlet valve element disk is displaced from at least a portion of the circular surface in the opened position of the inlet valve element disk.

7. The trigger sprayer of claim 6, further comprising:

a valve seat insert that is inserted through the liquid inlet opening into the liquid supply passage, the circular surface being on the valve seat insert.

8. The trigger sprayer of claim 7, further comprising:

a dip tube connected to the valve seat insert.

9. A manually operated trigger sprayer comprising:

a sprayer housing having a liquid outlet opening and a liquid inlet opening in the sprayer housing, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

a unitary valve member in the sprayer housing having an inlet valve element and an outlet valve element, the inlet valve element being positioned in the liquid supply passage and being movable between a closed position closing the liquid supply passage and an opened position opening the liquid supply passage in response to the pump piston moving to the discharge and charge positions, respectively, and the outlet valve element being positioned in the liquid discharge passage and being movable between a closed position closing the liquid discharge passage and an opened position opening the liquid discharge passage in response to the pump piston moving to the charge and discharge positions, respectively; and, the inlet valve element being a disk and the outlet valve element being a tube.

10. The trigger sprayer of claim 9, further comprising:

the liquid discharge passage having an interior surface;

an outlet passage in the sprayer housing communicating the pump chamber with the liquid discharge passage; and, the outlet valve element tube overlaying the outlet passage and at least a portion of the liquid discharge passage interior surface in the closed position of the outlet valve element tube and the outlet valve element tube being displaced from the outlet passage and at least a portion of the liquid discharge passage interior surface in the opened position of the outlet valve element tube.

11. The trigger sprayer of claim 9, further comprising:

a circular surface in the sprayer housing and around the liquid supply passage; and the inlet valve element disk overlaying the circular surface in the closed position of the inlet valve element disk and the inlet valve element is displaced from at least a portion of the circular surface in the opened position of the inlet valve element disk.

12. A manually operated trigger sprayer comprising:

a sprayer housing having a liquid outlet opening and a liquid inlet opening in the sprayer housing, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

a unitary valve member in the sprayer housing having an inlet valve element and an outlet valve element, the inlet valve element being positioned in the liquid supply passage and being movable between a closed position closing the liquid supply passage and an opened position opening the liquid supply passage in response to the pump piston moving to the discharge and charge positions, respectively, and the outlet valve element being positioned in the liquid discharge passage and being movable between a closed position closing the liquid discharge passage and an opened position opening the liquid discharge passage in response to the pump piston moving to the charge and discharge positions, respectively; and, a trigger mounted on the sprayer housing for pivoting movement of the trigger, the trigger having an integral spring arm extending from the trigger and engaging with the sprayer housing.

13. A manually operated trigger sprayer comprising:

a sprayer housing having a liquid outlet opening and a liquid inlet opening, a pump chamber in the sprayer housing, a liquid discharge passage extending through the sprayer housing from the pump chamber to the liquid outlet opening, the liquid discharge passage having an interior surface, a liquid supply passage extending through the sprayer housing from the liquid inlet opening to the pump chamber, the liquid supply passage having an interior surface;

a pump piston mounted in the pump chamber for reciprocating movement between charge and discharge positions of the pump piston in the pump chamber;

an inlet valve element disk with a peripheral edge positioned in the liquid supply passage and being movable between a closed position where the inlet element disk peripheral edge engages with the liquid supply passage interior surface and an opened position where the inlet valve element disk peripheral edge at least partially disengages from the liquid supply passage interior surface in response to the pump piston moving to the discharge and charge positions, respectively; and, an outlet valve element tube with an exterior surface positioned in the liquid discharge passage and being movable between a closed position where the outlet valve element tube exterior surface engages with the liquid discharge passage interior surface and an opened position where the outlet valve element tube exterior surface at least partially disengages from the liquid discharge passage interior surface in response to the pump piston moving to the charge and discharge positions, respectively.

14. The trigger sprayer of claim 13, further comprising:

the pump chamber having an inlet passage that communicates the pump chamber with the liquid supply passage and the pump chamber having an outlet passage that communicates the pump chamber with the liquid discharge passage;

the outlet valve element tube overlaying the pump chamber outlet passage and being displaced from the pump chamber outlet passage in the respective closed and opened positions of the outlet valve element tube.

15. The trigger sprayer of claim 14, further comprising:

a circular surface inside the sprayer housing with an opening through the circular surface, the liquid supply passage extending through the opening in the circular surface; and, the inlet valve element disk overlaying the opening in the circular surface and being at least partially displaced from the opening in the circular surface in the respective closed and opened positions of the inlet valve element disk.

16. The trigger sprayer of claim 15, further comprising:

the inlet valve element disk peripheral edge overlaying the circular surface and being at least partially displaced from the circular surface in the respective closed and opened positions of the inlet valve element disk.

17. The trigger sprayer of claim 15, further comprising:

a valve seat insert that is inserted through the liquid inlet opening into the liquid supply passage, the circular surface being on the valve seat insert and the opening in the circular surface extending through the valve seat insert.

18. The trigger sprayer of claim 17, further comprising:

a dip tube connected to the valve seat insert.

19. The trigger sprayer of claim 13, further comprising:

a trigger mounted on the sprayer housing for pivoting movement of the trigger, the trigger having an integral spring arm extending from the trigger and engaging with the trigger sprayer housing.

20. A manually operated trigger sprayer comprising:

a sprayer housing having a liquid outlet opening and a liquid inlet opening, a pump chamber in the sprayer housing, a liquid discharge passage extending through the sprayer housing from the pump chamber to the liquid outlet opening and a liquid supply passage extending through the sprayer housing from the liquid inlet opening to the pump chamber;

a pump piston mounted in the pump chamber for reciprocating movement between charge and discharge positions of the pump piston in the pump chamber;

an outlet valve element positioned in the liquid discharge passage and being movable between a closed position closing the liquid discharge passage and an opened position opening the liquid discharge passage in response to the pump piston moving to the respective charge and discharge positions;

a valve seat insert that is inserted through the liquid inlet opening into the liquid supply passage, the valve seat insert having a circular surface with an opening in the circular surface, the liquid supply passage extending through the opening in the circular surface; and, an inlet valve element disk with a peripheral edge positioned in the liquid supply passage and being movable between a closed position where the inlet valve element disk peripheral edge engages with the circular surface closing the liquid supply passage and an opened position where the inlet valve element disk peripheral edge is at least partially disengaged from the circular surface opening the liquid supply passage in response to the pump piston moving to the respective discharge and charge positions.

21. The trigger sprayer of claim 20, further comprising:

a dip tube connected to the valve seat insert.

22. The trigger sprayer of claim 20, further comprising:

the sprayer housing having a common passage in the sprayer housing between the liquid discharge passage and the liquid supply passage and the outlet valve element, the inlet valve element disk and the valve seat insert being inserted through the liquid inlet opening into the liquid discharge passage and the liquid supply passage.

23. The trigger sprayer of claim 22, further comprising:

the outlet valve element and the inlet valve element disk being part of a unitary valve member that is inserted through the liquid inlet opening.

24. The trigger sprayer of claim 23, further comprising:

the unitary valve member having a base with the outlet valve element and the inlet valve element disk being on opposite sides of the base; and the base is inserted into the common passage.

25. The trigger sprayer of claim 20, further comprising:

the valve seat insert having a cylindrical exterior surface that engages with the sprayer housing to hold the valve seat insert in the liquid supply passage.

26. The trigger sprayer of claim 25, further comprising:

the valve seat insert cylindrical exterior surface having opposite ends with the circular surface being at one end, the opening in the circular surface being one of a plurality of openings in the circular surface that extended through the valve seat insert between the opposite ends; and a post on the valve seat insert surrounded by the plurality of openings in the circular surface, the post engaging with the inlet valve element disk.

27. The trigger sprayer of claim 20, further comprising:

a trigger mounted on the sprayer housing for pivoting movement of the trigger, the trigger having a pair of integral spring arms extending from the trigger and engaging with opposite sides of the sprayer housing.

* * * * *